US007201141B2

(12) United States Patent
Rauch et al.

(10) Patent No.: US 7,201,141 B2
(45) Date of Patent: Apr. 10, 2007

(54) APPARATUS FOR CONTROLLING THROTTLE SHAFT DEFLECTION AND FRICTION IN DUAL BORE THROTTLE BODIES

(75) Inventors: James Richard Rauch, Grass Lake, MI (US); Bruce Raymond Beyer, Farmington Hills, MI (US)

(73) Assignee: Ford Motor Company, Dearborn, MI (US)

( * ) Notice: Subject to any disclaimer, the term of this patent is extended or adjusted under 35 U.S.C. 154(b) by 549 days.

(21) Appl. No.: 10/770,024

(22) Filed: Feb. 2, 2004

(65) Prior Publication Data

US 2005/0166892 A1 Aug. 4, 2005

(51) Int. Cl.
*F02D 9/10* (2006.01)

(52) U.S. Cl. ..... 123/336; 137/595; 251/305

(58) Field of Classification Search ..... 123/336, 123/399; 137/595, 607, 862; 251/305, 23.2
See application file for complete search history.

(56) References Cited

U.S. PATENT DOCUMENTS

| | | | | |
|---|---|---|---|---|
| 2,529,572 | A | 11/1950 | Raybould | 251/308 |
| 4,840,146 | A * | 6/1989 | Yanagisawa et al. | 123/336 |
| 4,907,547 | A | 3/1990 | Daly | 123/184.53 |
| 5,427,141 | A | 6/1995 | Ohtsubo | 137/595 |
| 5,813,380 | A | 9/1998 | Takahashi et al. | 123/184.55 |
| 5,875,758 | A | 3/1999 | Fujita | 123/336 |
| 6,263,917 | B1 | 7/2001 | Evans | 137/595 |
| 6,619,256 | B2 | 9/2003 | Morgillo et al. | 123/336 |
| 2002/0023620 | A1 | 2/2002 | Paffrath | 123/336 |
| 2002/0056824 | A1 | 5/2002 | Rentschler et al. | 251/308 |

FOREIGN PATENT DOCUMENTS

| | | | |
|---|---|---|---|
| JP | 62-135623 | * | 6/1987 |

* cited by examiner

*Primary Examiner*—Tony M. Argenbright
(74) *Attorney, Agent, or Firm*—Gregory P. Brown; MacMillan, Sobanski & Todd

(57) ABSTRACT

A throttle body for an automobile includes a housing defining a plurality of bores separated by a central wall. A passageway is defined through the central wall. A shaft is rotatably received within the passageway. A plurality of plates is coupled with the shaft. A contacting preventing means is configured to selectively engage the shaft upon deflection of the shaft in the region of the central wall to prevent contact between the shaft and the housing.

21 Claims, 3 Drawing Sheets

APPARATUS FOR CONTROLLING THROTTLE SHAFT DEFLECTION AND FRICTION IN DUAL BORE THROTTLE BODIES

BACKGROUND

1. Field of the Invention

This invention generally relates to an air intake control device. More specifically, the invention relates to a throttle body in an internal combustion engine having a dual bore throttle body.

2. Related Technology

Throttle bodies regulate the airflow to an internal combustion engine where the air is mixed with gasoline. Internal combustion engines require a precise mixture of air and gasoline in order to run properly, and therefore throttle bodies are designed to adjustably control the airflow into the cylinders of the engine. In order to control the airflow that reaches the cylinders, the throttle body includes at least one throttle plate (hereinafter "plates") attached to a throttle shaft and configured such that each throttle plate is located within the throttle bores, or proximal to an end of each of the throttle bores. With rotation of the shaft, the throttle plates are able to selectively obstruct airflow through the throttle bores. More specifically, the throttle plates are able to rotate with respect to each of the bores in order to adjust the cross-sectional area of the bores that is not obstructed by the plates (the "effective area"), thus controlling the airflow that is permitted to flow through the throttle bores.

In order to effectively control the effective areas of the bores, the throttle plates are sized and shaped approximately the same as the cross-sections of the bores in order to completely or substantially obstruct the bores when a throttle plate is substantially perpendicular to the airflow (the "closed position"). Additionally, the throttle plates have a minimal thickness in order to not substantially obstruct the throttle bores when the plates are angled such that a throttle plate face is not substantially perpendicular to the airflow (the "open position").

During operation, when the engine is idling, the throttle plates are in the closed position because very little air is needed to mix with the small amount of fuel being injected into the engine. Conversely, the throttle plates are in a variety of open positions at operating speeds higher than idle because more air is needed to mix with the increased amount of fuel being provided to the engine.

When the throttle plates are closed, pressure builds on the upstream face of the throttle plate, which is the side of the plate that is closer to the air intake when the throttle plate is closed. If the pressure on the upstream face of the throttle plate is high enough, it may cause the shaft to deflect towards the engine, which can cause unwanted contact between throttle body components, excessive friction between moving parts, and premature part failure.

Plural-bore throttle bodies, such as dual-bore throttle bodies, are more susceptible to shaft deflection and premature part failure than single-bore throttle bodies due to length and the positioning of the dual-bore throttle shaft. Dual-bore throttle bodies include two bores and two throttle plates configured side-by-side on a common shaft. Thus, a dual-bore throttle shaft is approximately twice as long as a single-bore throttle shaft. Longer throttle shafts have a greater tendency to deflect than shorter throttle shafts. Additionally, dual-bore throttle bodies include a housing that forms the bores, and the housing typically includes an opening for rotatably receiving the approximate mid-point of the shaft. As with any rigid body, the shaft undergoes maximum deflection near its mid-point. Therefore, dual-bore throttle bodies are particularly susceptible to excessive wear at the point of contact between the throttle shaft mid-point and the housing support opening between the two bores.

Therefore, it is desirous to minimize both the throttle shaft deflection and the friction between moving parts.

SUMMARY

In overcoming the disadvantages and drawbacks of the known technology, the current invention provides an assembly that limits the deflection of the throttle shaft and minimizes the sliding friction between the throttle body's moving parts. The throttle body includes a housing that defines at least two bores (hereinafter "bores"), which provide airflow to an internal combustion engine. In order to precisely control the airflow into the engine, the bores are coupled with throttle plates rotatably connected to a throttle shaft. The throttle plates are approximately the same size and shape as the bores (and are located inside or near the ends of the bores) such that the airflow through the bores is substantially minimized or completely eliminated when the plates are in a "closed" position. Connected to a rotatable shaft, rotation of the plates controls the amount of airflow through the bores. When the plates are in the closed position, air pressure builds up on one side of the plates and causes the shaft to deflect towards the housing.

In order to minimize the friction between the shaft, which may be deflecting and/or rotating, and the housing, a bushing is inserted between the shaft and the midpoint support of the housing. The bushing may be connected to the housing and it may either selectively contact or permanently contact the shaft. More specifically, the shaft and bushing may only selectively contact each other during periods of shaft deflection or permanently contact each other regardless of shaft deflection. Preferably, the shaft and bushing selectively contact each other in order to minimize friction and part wear.

The bushing may be of various constructions, such as a ring-shaped bushing, a spring bushing, or a bearing assembly.

The ring-shaped bushing may be received in the housing via an opening that is concentric with the shaft. More specifically, the ring-shaped bushing is positioned in a recess in the midpoint support at the housing and the shaft extends through the housing and the ring-shaped bushing. Preferably, the bushing is inserted from one side of the midpoint support and includes a mechanism to limit the depth at which it is inserted into the midpoint support.

The spring bushing may be include a slit that permits expansion of the spring bushing diameter. More specifically, as the slit expands, the spring bushing can be snapped over the shaft. Preferably, the spring bushing is received in a reduced diameter portion of the shaft and, in its free state, exhibits an outer diameter that is greater than the outer diameter of the shaft and an inner diameter that is greater than the diameter of the shaft's reduced diameter portion.

The bearing assembly may include a rotating element that contacts the shaft and a support element that positions the rotating element with respect to the shaft. The rotating element may have a circular cross-section to create a smooth and continuous contact between the rotating element and the shaft, and the support element may be enclosed within the housing walls. The height of the rotating element with respect to the shaft may be adjustable.

The current invention may also include a plurality of bearings to rotatably receive the shaft. Additionally, a spacer may be coupled with a bearing to form a substantially air-tight seal.

DETAILED DESCRIPTION

Figure 1:
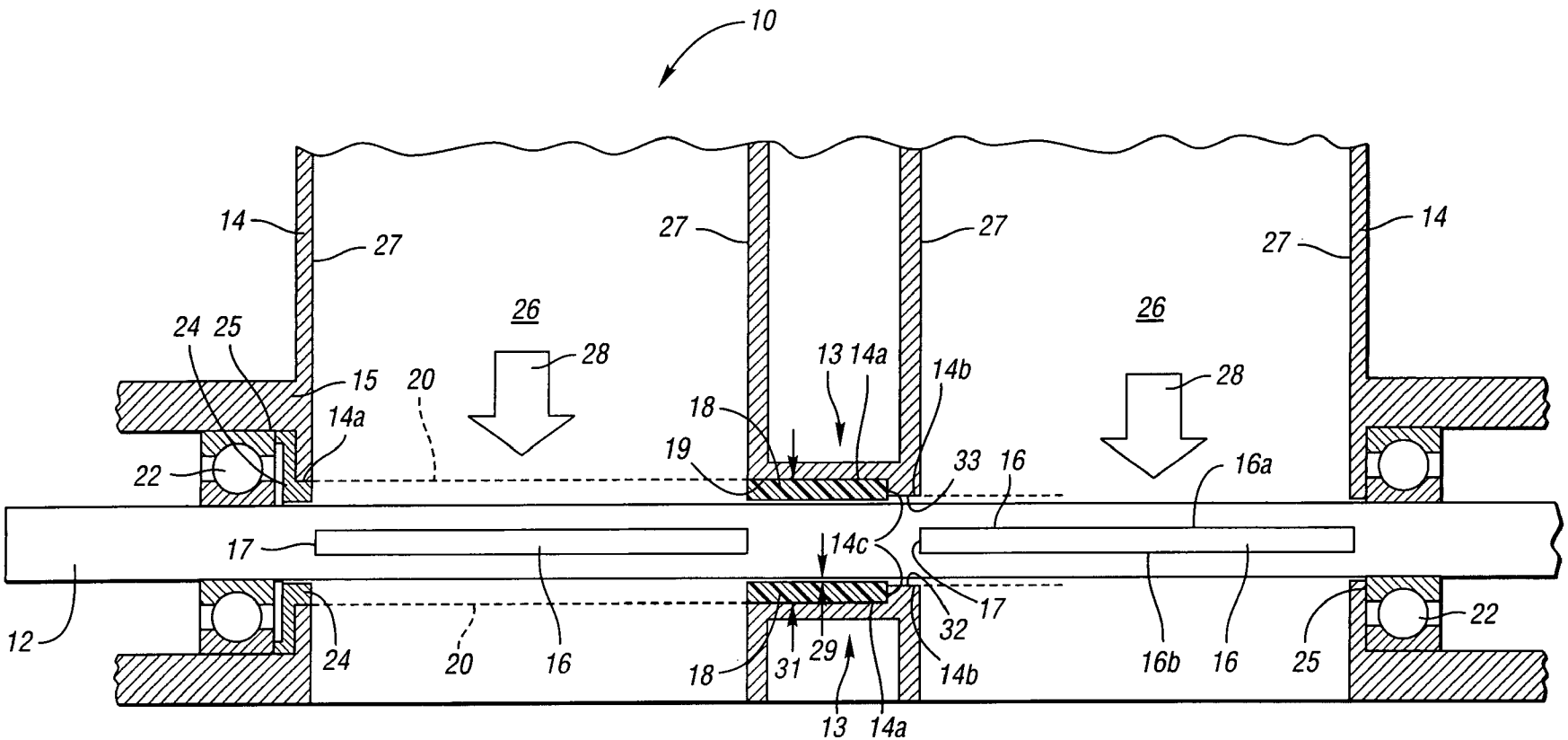
FIG. 1 is a partial cross-section of a dual-bore throttle body assembly embodying the principles of the present invention.

FIG. 1 shows a dual-bore throttle body 10, according to an embodiment of the present invention, used to control the airflow into an internal combustion engine of a motor vehicle. The dual-bore throttle body 10 is in fluid communication with the combustion cylinders of an internal combustion engine (not shown) and configured to control the airflow 28 into the cylinders. The dual-bore throttle body 10 includes a housing 14, preferably composed of aluminum material, defining a pair of bores 26 and rotatably receiving a shaft 12. A pair of throttle plates 16 (hereafter "plates") are fixedly coupled with the shaft 12 such that the throttle plates 16 rotate along with the shaft 12. During operation, the shaft 12 and throttle plates 16 control the airflow 28 through the bores 26 in order to achieve the optimal mix of air and fuel within the engine.

The shaft 12 is coupled with the housing 14 by bearings 22 to allow the shaft 12 to rotate with respect to the housing 14. The rotation of the shaft 12 is preferably controlled by a control device (not shown), such as a motor and a gear assembly, as will be further discussed below. The shaft 12 is typically composed of steel, brass, or similar materials.

As the shaft 12 rotates, the throttle plates 16 likewise rotate and change the angle between the throttle plates 16 and the bores 26. The plates 16 are positioned and shaped such that the circumference 17 of the throttle plates 16 approximates the inner surface 27 of the bores 26. More specifically, a plate 16 substantially blocks airflow through a bore 26 when the plate 16 is perpendicular to the bore inner surface 27 (when the plate 16 is in the "closed position"). As the shaft 12 rotates and the plate 16 is no longer in the closed position, the plate 16 no longer substantially prevents airflow through the bore (the plate is in the "open position"). The plates 16 are typically constructed of brass, aluminum, or a similarly suitable material.

During operation of the motor vehicle, airflow 28 from the exterior of the vehicle flows through the air induction system, into the bores 26 of the throttle assembly and towards the throttle plate top surface 16*a* . When the throttle plates 16 are in a closed position, as shown in FIG. 1, the pressure on the top surface 16*a* of the throttle plates 16 is greater than the resulting pressure on the bottom surface 16*b* . The pressure difference between the top surface 16*a* and the bottom surface 16*b* may cause the shaft 12 to deflect towards the housing lower surface 32, particularly at the midpoint of the shaft 12. In order to prevent premature part wear as a result of shaft deflection, a bushing comprised of a low friction material is inserted between the shaft 12 and a central wall 13 (the wall separating the two bores 27) of the housing 14. The low friction material in the bushing may be PTFE, such as Teflon™.

In one embodiment, the bushing is a ring-shaped bushing 18 with a substantially circular cross-section. The ring-shaped bushing 18 forms a closed loop, and it is coupled with the housing 14 by sliding the ring-shaped bushing 18 over the shaft 12. In order to slide the ring-shaped bushing 18 onto the shaft 12 and into position in the central wall 13, an outer wall 15 of the housing 14 has a first bore 14*a* with a diameter at least as large as an outer diameter 31 of the ring-shaped bushing 18. The housing also has a second bore 14*b* with a diameter at least as large as the outer diameter of the shaft 12. The diameter of the second bore 14*b* is preferably smaller than that of the first bore 14*a* in order to minimize air leakage around the shaft 12. The ring-shaped bushing 18 may have a convex end face to be substantially flush with the bore 27. The flush connection between the ring-shaped bushing 18 and the bore 27 minimized leakage around the shaft 12 and minimizes turbulent air flow.

The first bore 14*a* may be formed by drilling into the outer wall 15 and the central wall 13 along the machine path 20 shown in FIG. 1, or by other appropriate methods. The central wall 13 also preferably includes a shoulder 14*c* which separates the first and second bores 14*a*, 14*b* . The shoulder 14*c* is preferably substantially perpendicular to the first and second bores 14*a*, 14*b* in order to form an air-tight seal with the ring-shaped bushing 18.

Formed in this manner, the ring-shaped bushing 18 can be inserted onto the shaft 12 and slid into the first bore 14*a* by press-fitting, or by some other appropriate coupling method. The ring-shaped bushing 18 abuts shoulder 14*c* for lateral support.

In order to prevent excessive contact between the shaft 12 and the bushing 18, the inner diameter of ring-shaped bushing 18 is preferably greater than the diameter of the shaft 12. A gap 29 is thus located between the shaft 12 and the ring-shaped bushing 18 when the shaft 12 is in the undeflected position seen in FIG. 1. The gap 29 reduces contact between the shaft 12 and the ring-shaped bushing 18, minimizing premature part wear. As the shaft 12 deflects and contacts the ring-shaped bushing 18, the ring-shaped bushing 18 may or may not rotate along with the shaft 12, depending on the frictional forces between the shaft 12, the ring-shaped bushing 18, and the housing 14. Preferably, the ring-shaped bushing 18 does not rotate along with the shaft 12.

The dual-bore throttle body 10 is preferably substantially airtight in order to precisely control the airflow 26 into the internal combustion engine. More specifically, the shaft 12, the bearings 22 and the housing 14 form airtight seals. In order to form the seal 25 at the outer wall 15, a spacer 24 is inserted between the first bore, the shaft 12 and the bearings 22. The spacer 24 is preferably plastic, but may be comprised of other suitable materials.

Figure 2:
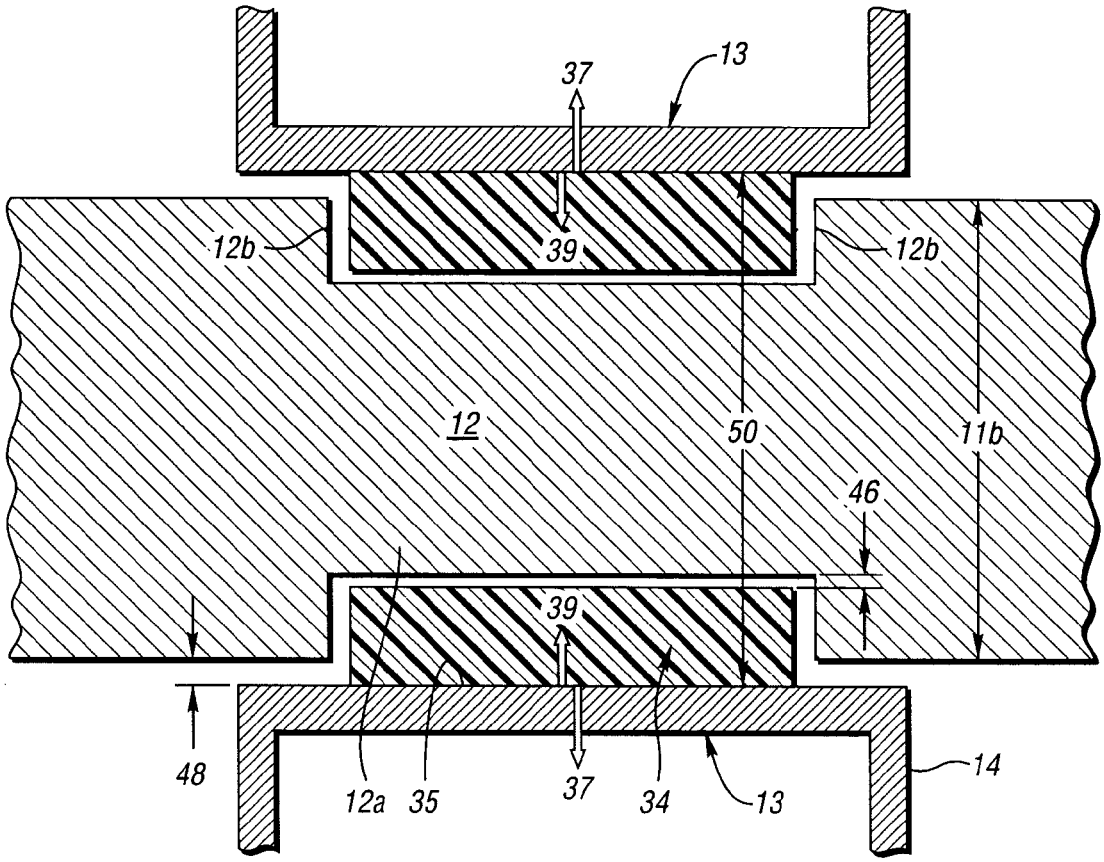
FIG. 2 is a close-up view of a partial cross-section of a second embodiment of the present invention, showing a spring bushing and a throttle shaft.
Figure 3A:
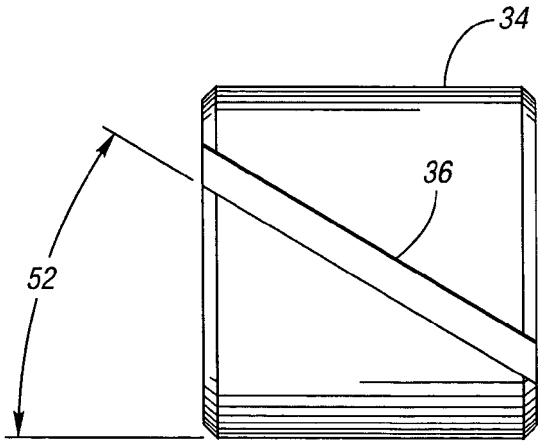
FIG. 3*a* is a front view of the spring bushing shown in FIG. 2.
Figure 3B:
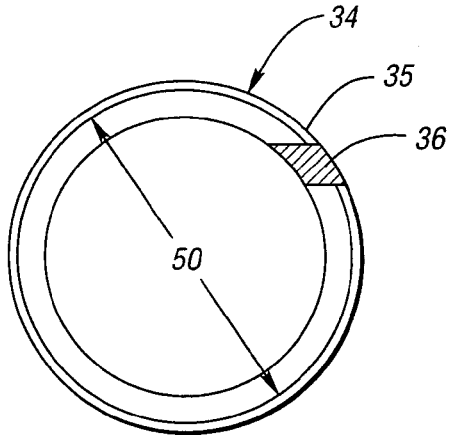
FIG. 3*b* is a side view of the spring bushing shown in FIG. 3*a*.

FIGS. 2, 3*a*, and 3*b* show another embodiment of the present invention. In this embodiment, a spring bushing 34 is coupled with the housing's central wall 13 by a spring force 37 biased towards the central wall 13. The spring bushing 34 is substantially circular and provided with a slit 36 allowing the spring bushing diameter 50 to be adjustable. More specifically, as a force is applied perpendicularly to the spring bushing outer surface 35, the spring bushing diameter 50 decreases or increases, depending on the direction of the force. As shown in FIG. 2, when the spring bushing 34 is coupled with the central wall 13 of the housing 14, a housing force 39 is applied to the spring bushing 34 that causes the spring bushing diameter 50 to be smaller than when the spring bushing 34 is in its relaxed state.

The shaft 12 in this embodiment preferably includes a reduced diameter section 12*a*, wherein the reduced diameter section 12*a* is smaller than the outer diameter of the shaft 12. When the spring bushing 34 is in a compressed state, the spring bushing diameter 50 is greater than the openings formed by the bearings 22. Additionally, when the spring bushing 34 is in a relaxed state, the spring pushing diameter 50 is greater than the opening formed by the central wall 13. Therefore, the spring bushing 34 is preferably installed according to the following steps. First, the shaft 12 is inserted through one of the bearings 22 until the reduced diameter section 12*a* of the shaft 12 is within one of the bores 26. Secondly, the spring bushing 34 is snapped onto the reduced diameter section 12*a*of the shaft 12. Finally, a radial force is applied to the spring bushing 34 such that the spring bushing diameter 50 is smaller than the opening formed by the central wall 13, and the spring bushing 34 and shaft 12 are inserted into the opening formed by the central wall 13.

A pair of shoulders 12*b* connect the reduced diameter section 12*a* and the outer diameter of the shaft 12. During operation, the shoulders 12*b* limit the axial movement of the spring clip bushing 34.

Similarly to the ring-shaped bushing 18, when the shaft 12 is undeflected, the spring bushing 34 does not contact the shaft 12 because the gap 46, between the spring bushing 34 and the reduced diameter section 12*a*, is smaller than the gap 48 between the central wall 13 and the outer diameter of the shaft 12. When the shaft 12 is deflected, the spring bushing 34 may or may not rotate along with the shaft 12 during contact between the spring bushing 34 and the rotating, deflected shaft 12.

In order to further minimize shaft 12 wear, the slit 36 is preferably not substantially parallel to the shaft 12. If the slit 36 is parallel to the shaft 12, the shaft 12 may contact the spring bushing 34 along the length of the slit 36, which causes a high pressure area due to the relatively small contact area between the shaft 12 and spring bushing 36. Therefore, the slit 36 is formed at an angle 52 that is preferably 15° to 45° with respect to the shaft 12. More preferably, the slit angle 52 is 25° to 35° with respect to the shaft 12.

Figure 4:
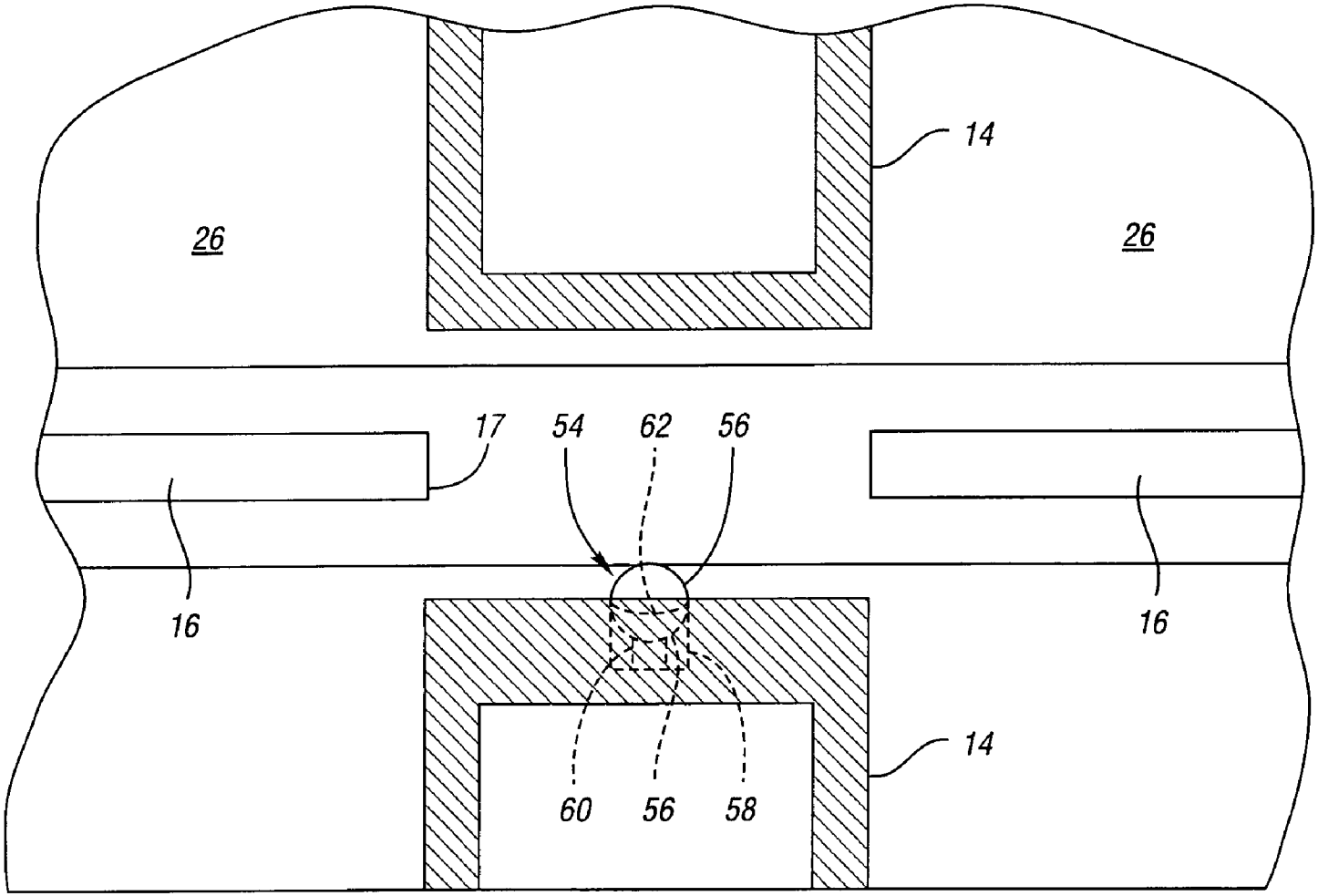
FIG. 4 is a partial cross-section of a third embodiment of the present invention.

FIG. 4 shows another embodiment of the present invention, including a bearing assembly 54. The bearing assembly 54 includes a rotatable element 56 rotatably received by a support element 58. The rotatable element 56 freely rotates with respect to the support element 58 in order to provide a low friction contact with the shaft 12 via rolling contact. More specifically, the rotatable element 56 rotates along with the shaft 12 when the shaft 12 and the rotatable element 56 contact each other. The rotatable element 56 and the shaft 12 preferably only contact each other during shaft 12 deflection. However, the rolling contact between the shaft 12 and rotatable element 56 causes less friction than the sliding contact between a stationary bushing and the shaft 12, so the part wear is minimal, even if continuous contact occurs between the shaft 12 and the rotatable element 56.

In order to provide free rotation between the shaft 12 and the rotatable element 56, the rotatable element 56 has a substantially circular cross section taken along a plane perpendicular to the shaft 12. More preferably, the rotatable element 56 is spherical-shaped in order to provide static contact regardless of the angle of the contact.

The support element 58 is preferably encased within the central wall 13 such that only the rotatable element 56 projects from the central wall 13. The support element 58 may also include a positioning element 60, such as a spring or a screw, to adjust the height of the rotatable element 56 with respect to the shaft 12. However, other appropriate configurations may be used to adjust the height of the rotatable element 56.

The support element 58 includes a receiving end 62 that rotatably receives the rotatable element 56. Therefore, the shape and size of the receiving end 62 depend on the shape and size of the rotatable element 56. In FIG. 4, the receiving end 62 is cup-shaped to receive the spherical rotatable element 56. However, other appropriate configurations may be used.

It is therefore intended that the foregoing detailed description be regarded as illustrative rather than limiting, and that it be understood that it is the following claims, including all equivalents, that are intended to define the spirit and scope of this invention.

The invention claimed is:

1. A throttle body for an automobile, comprising:

a housing defining a plurality of bores separated by a central wall, a passageway defined through the central wall;

a shaft rotatably received within the passageway;

a plurality of plates coupled with the shaft; and a contact preventing means configured to selectively engage the shaft upon deflection of the shaft in the region of the central wall, and to prevent contact between the shaft and the housing.

2. A throttle body for an automobile, comprising:

a housing defining a plurality of bores separated by a central wall, a passageway defined through the central wall;

a shaft rotatably received within the passageway;

a plurality of plates coupled with the shaft; and a bushing located in the passageway between the central wall and the shaft and configured to selectively engage the shaft upon deflection of the shaft in the region of the central wall, and to prevent contact between the shaft and the housing;

the passageway including a plurality of openings, the openings including at least a first opening with a first diameter and a second opening with a second diameter, wherein the first diameter is not substantially equal to the second diameter.

3. A throttle body as in claim 2, wherein the central wall includes a first section in contact with the bushing and a second section adjacent to the first section and not in contact with the bushing, wherein a first distance between an edge of the shaft and the first section measured perpendicular to the shaft is greater than a second distance between the edge of the shaft and the second section measured perpendicular to the shaft.

4. A throttle body as in claim 2, further including:

a plurality of bearing structures coupled with the housing and configured to rotatably receive the shaft; and a spacer coupled with the shaft;

the spacer and at least one of the bearing structures configured to cooperatively form a seal.

5. A throttle body for an automobile, comprising:

a housing defining a plurality of bores separated by a central wall, a passageway defined through the central wall;

a shaft rotatably received within the passageway and configured to rotate around a shaft axis;

a plurality of plates coupled with the shaft; and a spring bushing having a cross-sectional diameter, the spring bushing configured to connect with the central wall via a spring force urging the cross-sectional diameter to expand, the spring bushing configured to engage the shaft and to prevent contact between the shaft and the housing.

6. A throttle body as in claim 5, the spring bushing including a slit configured to permit the cross-sectional diameter to expand.

7. A throttle body as in claim 6, wherein the slit is not substantially parallel with the shaft axis.

8. A throttle body as in claim 7, wherein the slit and the shaft axis form an angle of between 15 degrees and 45 degrees.

9. A throttle body as in claim 7, wherein the slit and the shaft axis form an angle of between 25 degrees and 35 degrees.

10. A throttle body as in claim 7, the spring bushing having a generally circular cross-section.

11. A throttle body as in claim 5, wherein the spring bushing selectively engages the shaft based on the deflection of the shaft in the region of the central wall.

12. A throttle body for an automobile, comprising:

a housing defining a plurality of bores separated by a central wall, a passageway defined through the central wall;

a shaft rotatably received within the passageway;

a plurality of plates coupled with the shaft; and a bearing assembly located in the passageway between the central wall and the shaft and configured to contact the shaft, to rotate with respect to the housing, and to prevent contact between the shaft and the housing.

13. A throttle body as in claim 12, wherein the bearing assembly includes a rotating element configured to rotate at a bearing rotation speed, wherein the shaft rotates at a shaft rotation speed, and wherein the bearing rotation speed depends on the shaft rotation speed.

14. A throttle body as in claim 13, wherein the bearing rotation speed and the shaft rotation speed are substantially equal when the bearing assembly is in contact with the shaft.

15. A throttle body as in claim 12, wherein the bearing assembly includes a rotating element and a support element, the support element configured to rotatably receive the rotating element.

16. A throttle body as in claim 15, wherein the rotating element has a substantially circular cross-section.

17. A throttle body as in claim 16, wherein the rotating element is substantially spherical shaped.

18. A throttle body as in claim 15, wherein the support element is substantially enclosed within the central wall.

19. A throttle body as in claim 15, further including a positioning element configured to adjust the position of the rotating element with respect to the shaft.

20. A throttle body as in claim 15, wherein the support element includes a receiving element configured to receive the rotating element.

21. A throttle body as in claim 12, wherein the bearing assembly selectively engages the shaft based upon the deflection of the shaft in the region of the central wall.

* * * * *